US009583029B1

(12) United States Patent
Chestnut

(10) Patent No.: US 9,583,029 B1
(45) Date of Patent: Feb. 28, 2017

(54) FLAG-HOLDING DEVICE

(71) Applicant: Robert Chestnut, Grove City, PA (US)

(72) Inventor: Robert Chestnut, Grove City, PA (US)

( * ) Notice: Subject to any disclaimer, the term of this patent is extended or adjusted under 35 U.S.C. 154(b) by 0 days.

(21) Appl. No.: 15/187,890

(22) Filed: Jun. 21, 2016

(51) Int. Cl.
*G09F 17/00* (2006.01)
*G09F 7/18* (2006.01)
*G09F 15/00* (2006.01)

(52) U.S. Cl.
CPC ..... *G09F 17/00* (2013.01); *G09F 7/18* (2013.01); *G09F 15/0018* (2013.01); *G09F 15/0037* (2013.01); *G09F 2007/1804* (2013.01); *G09F 2017/0066* (2013.01)

(58) Field of Classification Search
CPC ..... G09F 17/00; G09F 7/18
See application file for complete search history.

(56) References Cited

U.S. PATENT DOCUMENTS

D4,565 S 1/1871 Tifft
1,025,904 A * 5/1912 Earhart ..... G09F 17/00 116/173
D51,647 S 1/1918 Lawton
1,455,882 A 5/1923 Harding
2,023,519 A * 12/1935 Durrett ..... E04H 13/003 40/124.5
2,148,660 A * 2/1939 Sweeney ..... E04H 13/00 40/124.5
2,153,229 A 9/1969 Huston
3,977,110 A * 8/1976 Yerger ..... G09F 17/00 116/173
4,134,222 A * 1/1979 Orsos ..... G09F 7/20 248/484
4,233,769 A * 11/1980 Archer ..... G09F 7/20 248/530
4,520,985 A 6/1985 Blumenthal
4,524,533 A * 6/1985 Still, Jr. ..... G09F 7/18 248/156
4,864,757 A * 9/1989 Lovett ..... G09F 7/18 24/561
5,454,178 A * 10/1995 Rivard ..... G09F 7/18 248/535
D376,890 S * 12/1996 Caldwell ..... D99/17
D476,131 S * 6/2003 Barnes ..... D99/18
7,934,690 B1 * 5/2011 Walter ..... E04H 13/001 248/539
2004/0221501 A1 * 11/2004 Schaak ..... A47G 1/143 40/747
2009/0139124 A1 * 6/2009 Cowgill ..... G09F 17/00 40/610
2015/0040443 A1 2/2015 Marco

FOREIGN PATENT DOCUMENTS

DE 102012014431 A1 1/2014

* cited by examiner

*Primary Examiner* — Gary Hoge

(57) ABSTRACT

The flag holding device is a mounting device that is adapted to receive a flag pole. The flag holding device is inserted into the ground. The flag holding device comprises a post and a sign. The sign is attached to the post. The post is inserted into the ground. The sign is configured to receive and hold a flag pole to which a flag is attached.

6 Claims, 4 Drawing Sheets

FLAG-HOLDING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of display of signs, labels, name-plates or seals, more specifically, a mounting for flags and banners.

SUMMARY OF INVENTION

The flag holding device is a mounting device that is adapted to receive a flag pole. The flag holding device is inserted into the ground. The flag holding device comprises a post and a sign. The sign is attached to the post. The post is inserted into the ground. The sign is configured to receive and hold a flag pole to which a flag is attached.

These together with additional objects, features and advantages of the flag holding device will be readily apparent to those of ordinary skill in the art upon reading the following detailed description of the presently preferred, but nonetheless illustrative, embodiments when taken in conjunction with the accompanying drawings.

In this respect, before explaining the current embodiments of the flag holding device in detail, it is to be understood that the flag holding device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flag holding device.

It is therefore important that the claims be regarded as including such equivalent construction insofar as they do not depart from the spirit and scope of the flag holding device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
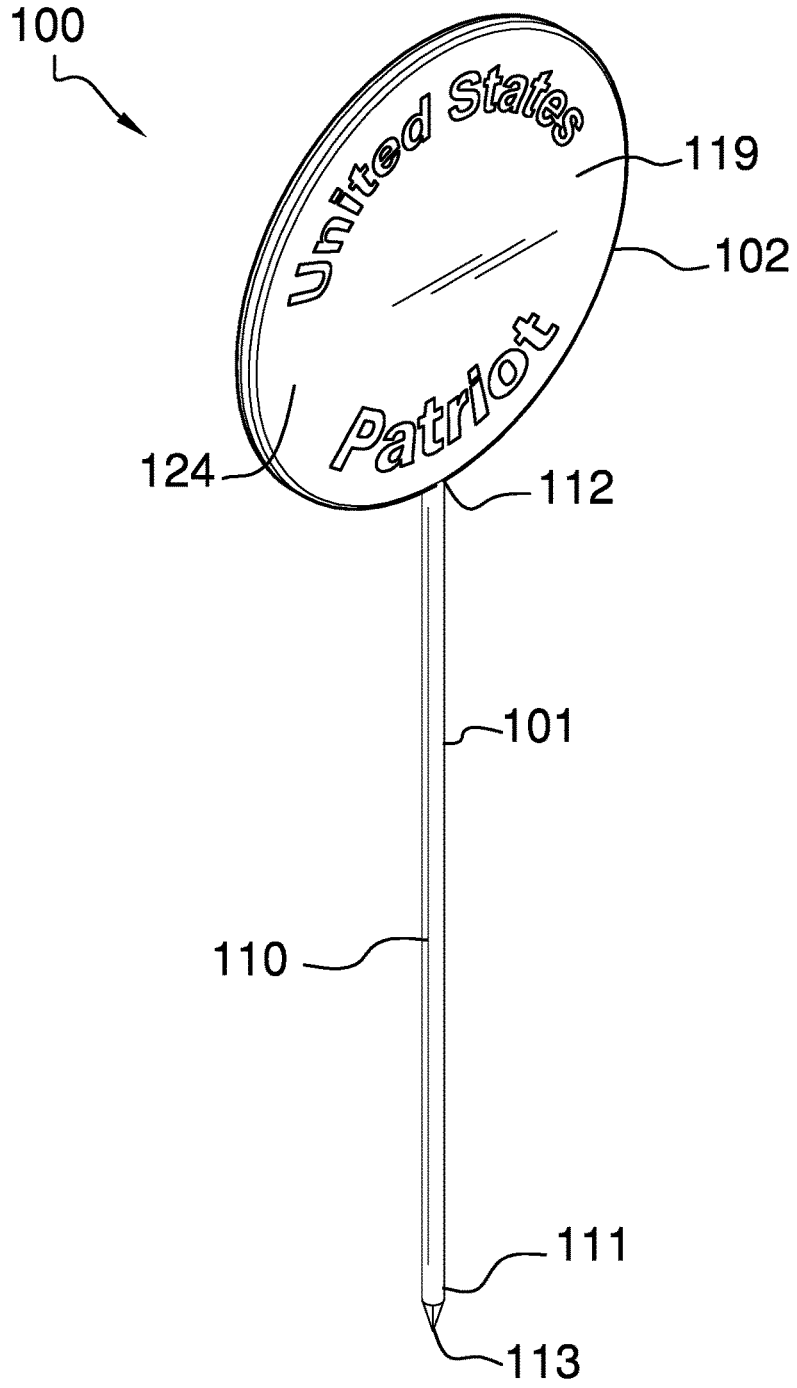
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The flag holding device 100 (hereinafter invention) comprises a post 101 and a sign 102. The invention 100 is a mounting device that is adapted to receive a flag 131 pole 132. The flag 131 pole 132 is further defined with an outer diameter. The invention 100 is inserted into the ground 133. The sign 102 is attached to the post 101. The post 101 is inserted into the ground 133. The sign 102 is configured to receive and hold a flag 131 pole 132 to which a flag 131 is attached.

The post 101 comprises a shaft 110, a tapered point 113, and an attachment 114. The shaft 110 is further defined with a first end 111 and a second end 112. The attachment 114 and the tapered point 113 are attached to the shaft 110.

In the first potential embodiment of the disclosure, the shaft 110 is the structure that raises the sign 102 above the ground 133. The shaft 110 is a cylindrically shaped object. As shown most clearly in FIG. 3, the first end 111 of the shaft 110 is formed with a taper that reduces the first end 111 to a point. This point allows the shaft 110 to be driven into the ground 133 thus anchoring the invention 100. The attachment 114 is mounted on the second end 112 of the shaft 110. The attachment 114 attaches the sign 102 to the post 101.

Figure 4:
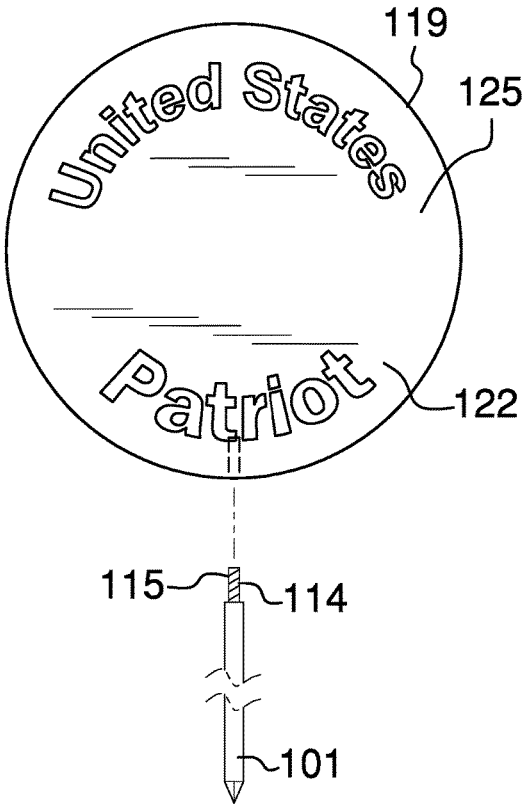
FIG. 4 is a front view of an embodiment of the disclosure.
Figure 5:
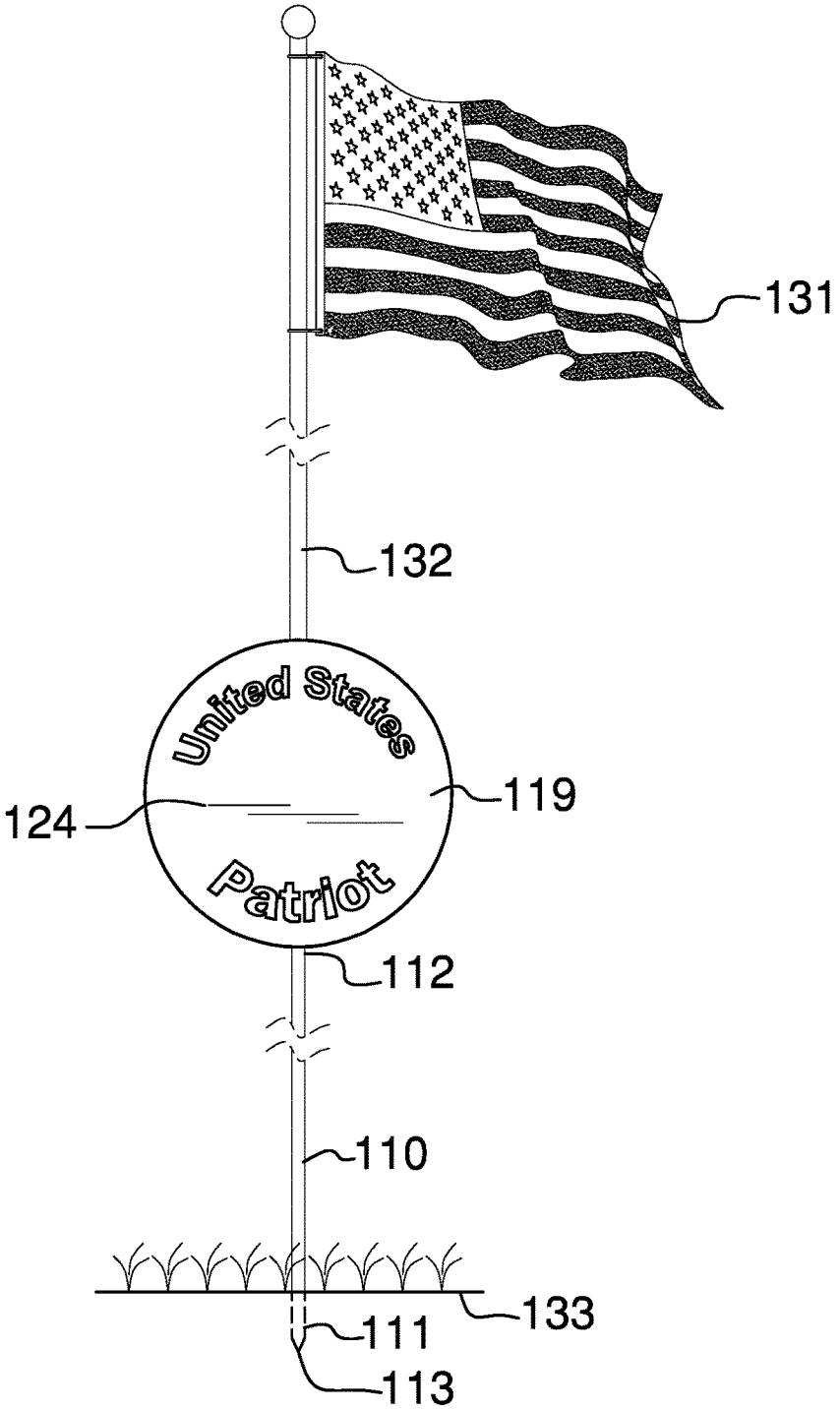
FIG. 5 is an in use view of an embodiment of the disclosure.

In the first potential embodiment of the disclosure, as shown most clearly in FIG. 4, the attachment 114 is a threaded connection 115. In a second potential embodiment of the disclosure, as shown most clearly in FIG. 2, the attachment 114 is a hinged connection 116. The hinged connection 116 is a readily and commercially available locking hinge.

The sign 102 comprises a placard 119 and a plurality of lugs 120. The placard 119 is further defined with a display side 124 and a non-display side 125. The plurality of lugs 120 comprises a first lug 121 and a capped lug 123. The plurality of lugs 120 are mounted on the non-display side 125 of the placard 119.

Figure 2:
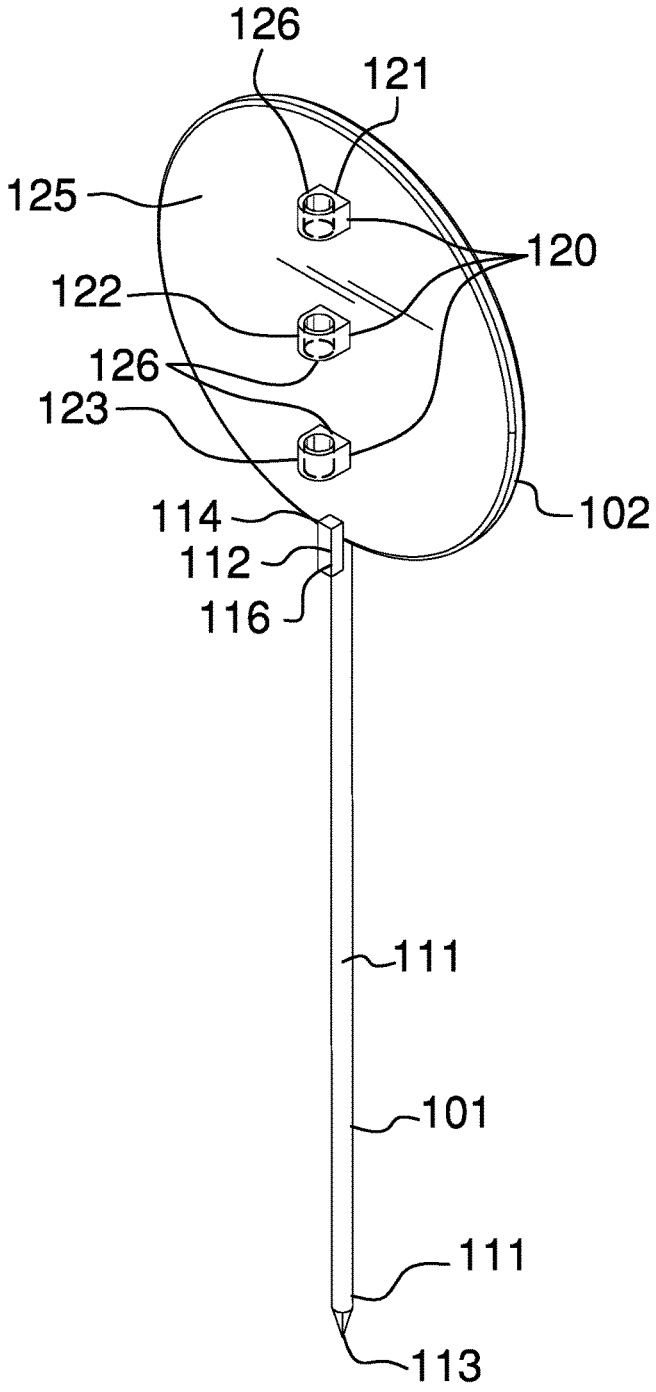
FIG. 2 is a back view of an embodiment of the disclosure.

In the first potential embodiment of the disclosure, as shown most clearly in FIG. 2, the placard 119 is a plate upon which and image is displayed on the display side 124 and the plurality of lugs 120 are mounted on the non-display side 125. The plurality of lugs 120 are a collection of individual lugs 126. Each individual lug 126 is further defined with an inner diameter. The span of the inner diameter of each individual lug 126 is greater than the span of the outer diameter of the flag 131 pole 132 such that the flag 131 pole 132 can be inserted through or into each individual lug 126. Each individual lug 126 is mounted on the non-display side 125 of the placard 119 such that the center axis of each individual lug 126 selected from the plurality of lugs 120 is aligned with the center axes of the lugs remaining in the plurality of lugs 120. With this arrangement, the flag 131 pole 132 can be secured to the placard 119 by inserting the flag 131 pole 132 through each of the plurality of lugs 120 such that the center axis of the flag 131 pole 132 aligns with the center axes of each of the plurality of lugs 120.

At a minimum, the plurality of lugs 120 comprises a first lug 121 and a capped lug 123. The first lug 121 is formed with two openings thus allowing a flag 131 pole 132 to be inserted through the first lug 121. The capped lug 123 has a closed end that acts as a surface upon which the flag 131 pole 132 will rest. In any embodiment of the disclosure, the plurality of lugs 120 will only contain one capped lug 123 and at least a first lug 121. The plurality of lugs 120 may potentially comprise additional lugs with two openings. These additional lugs will improve the stability of the flag 131 pole 132.

Figure 3:
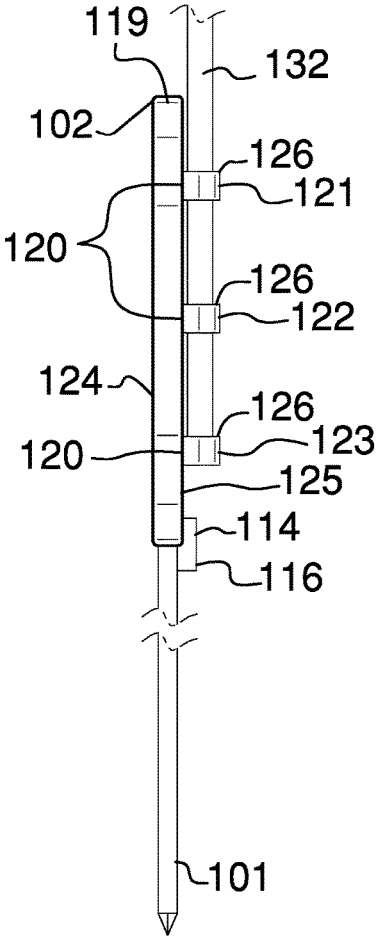
FIG. 3 is a side view of an embodiment of the disclosure.

In a second potential embodiment of the disclosure, as shown most clearly in FIGS. 2 and 3, the plurality of lugs 120 further comprises a second lug 122.

To use the invention 100, the sign 102 is attached to the post 101 using the attachment 114. The tapered point 113 is then inserted into the ground 133 and a flag 131 pole 132 is inserted into the plurality of lugs 120.

The following definitions were used in this disclosure:

Anchor: As used in this disclosure, anchor means to hold an object firmly or securely.

Capped Pipe: As used in this disclosure, a capped pipe is a pipe with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Exterior Screw Thread: An exterior screw thread is a ridge wrapped around the outer surface of a tube in the form of a helical structure that is used to convert rotational movement into linear movement.

Flag: As used in this disclosure, a flag is a textile or sheeting material that attached by one edge to a pole or a rope. In general usage, a flag will display an image that often contains some form of symbolic meaning or message. This definition maps to the common patent classification definitions and is therefore explicitly intended to include flag like objects commonly referred to as a "banner".

Flag Pole: As used in this disclosure, a flag pole is a shaft to which a flag is attached.

Interior Screw Thread: An interior screw thread is a groove that is formed around the inner surface of a tube in the form of a helical structure that is used to convert rotational movement into linear movement.

Inner Diameter: As used in this disclosure, the term inner diameter is used in the same way that a plumber would refer to the inner diameter of a pipe.

Hinge: As used in this disclosure, a hinge is a device that permits the turning, rotating, or pivoting of a first object relative to a second object.

Lug: As used in this disclosure, a lug is a pipe like disk structure that is formed such that a shaft can be inserted through the lug. A capped lug is a lug with one closed end that is used to secure an end of the shaft.

Pipe: As used in this disclosure, the term pipe is used to describe a rigid hollow cylinder. While pipes that are suitable for use in this disclosure are often used to transport or conveys fluids or gasses, the purpose of the pipes in this disclosure are structural. In this disclosure, the terms inner diameter of a pipe and outer diameter are used as they would be used by those skilled in the plumbing arts.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Outer Diameter: As used in this disclosure, the term outer diameter is used in the same way that a plumber would refer to the outer diameter of a pipe.

Shaft: As used in this disclosure, the term shaft is used to describe a rigid cylinder that is often used as the handle of a tool or implement. The terms inner diameter of the shaft and outer diameter of the shaft are used as they would be used by those skilled in the plumbing arts. The definition of shaft explicitly includes solid shafts or shafts that are formed more like pipes with a hollow passage through the shaft that runs along the center axis of the shaft cylinder.

Sign: As used in this disclosure, a sign is a placard that displays an image, potentially including a text based image, which contains some form of symbolic meaning or message.

Taper: As used in this disclosure, a taper is a continuous, and typically but not necessarily gradual, change in the span of a one or more dimensions of an elongated object that occurs in the apparent direction of elongation.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mount comprising:
a post and a sign;
wherein the mount is a mounting device;
wherein the mounting device is adapted to receive a flag pole;
wherein the flag pole is further defined with an outer diameter;
wherein the mounting device is inserted into the ground;
wherein the sign is attached to the post;
wherein the post is inserted into the ground;
wherein the sign is configured to receive and hold the flag pole;
wherein the post comprises a shaft, a tapered point, and an attachment;
wherein the shaft is further defined with a first end and a second end;
wherein the attachment and the tapered point are attached to the shaft;
wherein the shaft is a cylindrically shaped object;
wherein the tapered point is formed at the first end of the shaft;
wherein the tapered point is a taper that reduces the first end to a point;
wherein the attachment is mounted on the second end of the shaft;
wherein the attachment attaches the sign to the post;
wherein the attachment is a threaded connection;
wherein the sign comprises a placard and a plurality of lugs;
wherein the placard is further defined with a display side and a non-display side;
wherein the plurality of lugs are mounted on the non-display side of the placard;
wherein the placard is a plate;
wherein the plurality of lugs are a collection of individual lugs;
wherein each individual lug is further defined with an inner diameter;
wherein the span of the inner diameter of each individual lug is greater than the span of the outer diameter of the flag pole;
wherein each individual lug is mounted on the non-display side of the placard such that the center axis of each individual lug selected from the plurality of lugs is aligned with the center axes of the lugs remaining in the plurality of lugs;
wherein the flag pole is secured to the placard by inserting the flag pole through each of the plurality of lugs such that the center axis of the flag pole aligns with the center axes of each of the plurality of lugs;
wherein the plurality of lugs comprises a first lug and a capped lug;
wherein the first lug formed with two openings;
wherein the capped lug has a closed end.

2. The mount according to claim 1 wherein the plurality of lugs further comprises a second lug.

3. The mount according to claim 2 wherein the point is anchored into the ground.

4. A mount comprising:
a post and a sign;
wherein the mount is a mounting device;
wherein the mounting device is adapted to receive a flag pole;
wherein the flag pole is further defined with an outer diameter;
wherein the mounting device is inserted into the ground;
wherein the sign is attached to the post;
wherein the post is inserted into the ground;
wherein the sign is configured to receive and hold the flag pole;
wherein the post comprises a shaft, a tapered point, and an attachment;
wherein the shaft is further defined with a first end and a second end;
wherein the attachment and the tapered point are attached to the shaft;
wherein the shaft is a cylindrically shaped object;
wherein the tapered point is formed at the first end of the shaft;
wherein the tapered point is a taper that reduces the first end to a point;
wherein the attachment is mounted on the second end of the shaft;
wherein the attachment attaches the sign to the post;
wherein the attachment is a hinged connection;
wherein the hinged connection is a locking hinge;
wherein the sign comprises a placard and a plurality of lugs;
wherein the placard is further defined with a display side and a non-display side;
wherein the plurality of lugs are mounted on the non-display side of the placard;
wherein the placard is a plate;
wherein the plurality of lugs are a collection of individual lugs;
wherein each individual lug is further defined with an inner diameter;
wherein the span of the inner diameter of each individual lug is greater than the span of the outer diameter of the flag pole;
wherein each individual lug is mounted on the non-display side of the placard such that the center axis of each individual lug selected from the plurality of lugs is aligned with the center axes of the lugs remaining in the plurality of lugs;
wherein the flag pole is secured to the placard by inserting the flag pole through each of the plurality of lugs such that the center axis of the flag pole aligns with the center axes of each of the plurality of lugs;

wherein the plurality of lugs comprises a first lug and a capped lug;

wherein the first lug formed with two openings;

wherein the capped lug has a closed end.

5. The mount according to claim 4 wherein the plurality of lugs further comprises a second lug.

6. The mount according to claim 5 wherein the point is driven into the ground.

* * * * *